United States Patent [19]

Tamura et al.

[11] Patent Number: 4,463,284

[45] Date of Patent: Jul. 31, 1984

[54] METHOD AND APPARATUS FOR CONTROLLING LUMINOUS INTENSITY OF FLUORESCENT LAMP OF REPRODUCING APPARATUS

[75] Inventors: Akihiko Tamura; Katsuhiro Shukuri; Kiyoaki Kawamoto; Haruo Iwahashi, all of Tokyo, Japan

[73] Assignee: Konishiroku Photo Industry Co., Ltd., Tokyo, Japan

[21] Appl. No.: 400,392

[22] Filed: Jul. 21, 1982

[30] Foreign Application Priority Data

Jul. 28, 1981 [JP] Japan ..... 56-118621
Jul. 28, 1981 [JP] Japan ..... 56-118622

[51] Int. Cl.[3] ..... H05B 41/36

[52] U.S. Cl. ..... 315/158; 315/151; 315/309; 355/68; 355/69

[58] Field of Search ..... 315/151, 158, 307, 309, 315/311, DIG. 7; 250/205; 355/68, 69

[56] References Cited

U.S. PATENT DOCUMENTS 3,599,037 8/1971 Grace ..... 315/158 X
3,826,569 7/1974 Sakamaki et al. ..... 355/69 X
4,124,294 11/1978 Nakamura ..... 355/68

*Primary Examiner*—Eugene R. LaRoche
*Attorney, Agent, or Firm*—James E. Nilles

[57] ABSTRACT

A method of controlling the luminous intensity of a fluorescent lamp of the reproducing apparatus characterized in that a first stage for detecting the amount of light from the fluorescent lamp is linked with a second stage for controlling the lamp current of the fluorescent lamp by use of an output corresponding to the detection output of the first stage as the input. A luminous intensity controlling apparatus for fluorescent lamp of the reproducing apparatus characterized in that the fluorescent lamp is a cold cathode type fluorescent lamp, and luminosity detection device for detecting the amount of light from the cold cathode type fluorescent lamp and lamp current control device for controlling the lamp current of the cold cathode type fluorescent lamp using an output corresponding to the detection output of the luminosity detection device as the input are linked with each other.

16 Claims, 7 Drawing Figures

METHOD AND APPARATUS FOR CONTROLLING LUMINOUS INTENSITY OF FLUORESCENT LAMP OF REPRODUCING APPARATUS

BACKGROUND OF THE INVENTION

1. Field of the Invention

This invention relates to the control of the luminous intensity of a cold cathode fluorescent lamp to be used for eliminating the electric charge or the like on the surface of a photoconductive photosensitive member (hereinafter referred to as a "photosensitive member") in an electrostatic reproducing apparatus (hereinafter referred to as a "reproducing apparatus") using the photosensitive member.

2. Description of the Prior Art

In a reproducing apparatus using a photosensitive member, reproduction is done by applying a uniform electrostatic charge to the surface of the photosensitive member, exposing it in accordance with a picture image so as to remove the electrostatic charge in accordance with the picture image and form an electrostatic latent image, forming a toner image on the surface of the photosensitive member by developing the electrostatic latent image, and thereafter transferring and fixing the toner image onto a transfer material such as transfer paper.

FIG. 1 illustrates portions of the reproducing apparatus to be applied with the present invention. Reference numeral 10 represents the photosensitive member (e.g. a drum); 101 is a charging means such as a corona discharger; 102 is optical exposing means for forming the electrostatic latent image; 103 is a developing means for forming the toner image; P is transfer paper that is placed on a paper feed tray; 104 is a paper feed roller for feeding the transfer paper P to the surface of the photosensitive member 10; 105 is a transfer/separation electrode for transferring the toner image to the transfer paper P and separating the transfer paper P with the toner image transferred to it from the surface of the photosensitive member 10; and 106 is a cleaner for removing residual toner from the surface of the photosensitive member 10 after the toner image is transferred.

To obtain a high quality picture it is extremely important to remove the residual electrostatic charge, and this is generally effected by exposing the surface of the photosensitive member 10 utilizing its photoelectric conductivity. (This procedure will be hereinafter referred to as "charge elimination.") Charge elimination is used not only to prepare an electrostatically uniform photosensitive member 10 prior to charging by the charging means but also to remove the electrostatic charge outside the region of the original on the surface of the photosensitive member 10 and for removing excess electrostatic charge other than the toner image before transfer.

In FIG. 1, reference numeral 11 represents charge eliminating means disposed upstream of the charging means 101 to remove the electrostatic charge on the surface of the photosensitive member 10 or make the fatigue of the photosensitive member uniform using light; and 12 represents partial exposing means that remove the electrostatic charge outside the region of the original when the optical system returns or during small-scale reproduction, and thus prevent the electrostatic charge from forming a dark frame around the picture image, from deteriorating the picture quality and from unnecessarily attaching to the surface of the photosensitive member 10 and being carried away and wasted. Reference numeral 13 represents exposing means before transfer that are interposed between the developing means 103 and the transfer/separation electrode 105, adjust the charge quantity of the electrostatic charge on the surface of the photosensitive member 10 and improve the transfer ratio of the toner image as well as separability of the transfer paper.

An incandescent lamp using the incandescent emission of a filament, a limit emitting diode (LED) or a fluorescent lamp has been employed as the light source for the abovementioned charge eliminating means 11, partial exposing means 12 and exposing means before exposure 13.

Among the abovementioned light sources, a plurality of incandescent lamps or LEDs must be arranged in order to illuminate a required area, so that the distribution of the luminous intensity becomes non-uniform and hence the charge elimination and optical fatigue of the photosensitive member are likely to be non-uniform. The incandescent lamp generates a lot of heat so that the photosensitive member is also likely to be degraded by the heat.

Since the fluorescent lamp is free of the abovementioned drawbacks, it is, in this sense, a suitable light source for charge elimination. However, since the vapor pressure of mercury sealed in the tube markedly varies with the temperature, the light emitting luminous intensity is significantly affected by the temperture inside the tube. FIG. 2 illustrates the relationship between them. The ordinate represents relative luminous intensity, which is plotted at 100% when the temperature of the tube wall is at 40° C., and the abscissa represents the tube wall temperature, which is substantially proportional to the temperature inside the tube, and is used herein as the temperature. As is obvious from this diagram, the relative luminous intensity shows a change of about 60% within a temperature range of from 10° C. to 40° C.

The temperature inside the tube of the fluorescent lamp changes with the ambient temperature of the fluorescent lamp that is determined by the conditions inside the reproducing apparatus, the place of installation and the season, and by the temperature rise inside the tube due to the heat that is generated by the discharge current of the lamp itself, though the heat generation is much smaller than that of an incandescent lamp.

Various problems such as photographic fog, drop of the toner transfer efficiency, so-called "jamming" of the transfer paper and the like when the fluorescent lamp is used as the light source for the charge elimination occur especially frequently when the temperature inside the tube of the fluorescent lamp is low. The state changes depending upon the time it has been lit because of the heat generated by the discharge current.

A cold cathode type fluorescent lamp (hereinafter referred to as the "cold cathode lamp") is available as a suitable lamp that does not show the unstability of the luminous intensity of the fluorescent lamp. The lamp current and relative luminous intensity of this cold cathode lamp show a good linear relation. FIG. 4 is a diagram showing this relation between the relative luminous intensity and the lamp current in which the luminous intensity is plotted at 100 when the lamp current is 5 mA. This lamp current can be easily changed by changing the output of a transformer 25 on its secondary side or a resistor R shown in FIG. 3 described below.

The cold cathode lamp is a quick starting type, has a small volume of about ⅓ that of the ordinary fluorescent lamp, and is more economical because it does not need an auxiliary device for lighting. The cold cathode lamp and its associated circuit are shown in FIG. 3. In the drawing, reference numeral 20 represents the cold cathode lamp; 21 is the fluorescent tube of the cold cathode lamp; 22 and 22' are electrodes disposed at both ends of the fluorescent tube 21; and 23 and 23' are caps. Reference numeral 24 is a member which may be called as an "adjacent conductor" which is extended from one 22 of the electrodes along the outer wall of the fluorescent tube 21 (on the side of atmosphere) to close to the other electrode 22' but does not come into contact with it, in the example shown in FIG. 3. This is made of a conductive paint film. Reference numeral 25 represents a transformer for passing current through the cold cathode lamp 20 and symbol R represents a resistor interposed between the transformer 25 and the cold cathode lamp 20 to control the lamp current.

When an a.c. voltage of 300 to 700 V is applied across the electrodes 22 and 22', discharge occurs between the adjacent conductor 24 and the electrode 22' adjacent the former, this discharge functions as a trigger and discharge occurs instantaneously and successively between the electrodes 22 and 22', thereby turning the lamp on. The lamp current of the cold cathode lamp required for discharge after lighting is from 1 to 10 mA and is much smaller than the lamp current on the order of several hundreds of mA of the ordinary fluorescent lamp. Accordingly, heat generated in the lamp by the lamp current can be substantially neglected, and the temperature of the fluorescent tube will be substantially equal to the ambient temperature.

As described above, the cold cathode lamp has various advantages in comparison with an ordinary fluorescent lamp. Since the principle of light emission of the cold cathode lamp is the same as that of the ordinary fluorescent lamp, however, the luminous intensity of the emitted light of the cold cathode lamp depends upon the temperature in the same way as in the ordinary fluorescent lamp as illustrated in FIG. 2. Nonetheless, heat generated of the cold cathode lamp itself can substantially be neglected, and since the relative luminous intensity is substantially proportional to the lamp current, the luminous intensity of the fluorescent lamp can be easily controlled by controlling the lamp current.

On the other hand, in order to provide a copy having high picture quality and to avoid problems such as jamming, the quantity of light emitted to the photosensitive member from the charge eliminating means 11, partial exposing means 12 and exposing means before transfer 13 described with reference to FIG. 1 must be maintained within practical tolerances. However, there have not been made any proposals in the past to maintain successively the luminous intensity of the light source for charge elimination or the quantity of light emitted.

SUMMARY OF THE INVENTION

The present invention is therefore directed to provide a method of successively maintaining, at a predetermined level, the luminous intensity of the light source for eliminating the electrostatic charge on the surface of a photosensitive member in a reproducing apparatus using the photosensitive member and also to provide an apparatus for successively maintaining the luminous intensity at a predetermined level based on such a method.

In a reproducing apparatus using a photoconductive photosensitive member, these objects of the present invention can be accomplished by a method of controlling the luminous intensity of the fluoresent lamp for the reproducing apparatus, which method is characterized in that a cold cathode type fluorescent lamp is used for eliminating the electrostatic charge on the surface of the photosensitive member, and a first stage for detecting the amount of light from the cold cathode fluorescent lamp is linked with a second stage for controlling the lamp current of the cold cathode fluorescent lamp by using an output corresponding to the detection output of the first stage as the input.

In a reproducing apparatus using a photoconductive photosensitive member, these objects of the invention can also be accomplished by a luminous intensity control apparatus for the fluorescent lamp of the reproducing apparatus, which luminous intensity control apparatus is characterized in that a cold cathode type fluorescent lamp is used for eliminating the electrostatic charge on the surface of the photosensitive member, and luminosity detection means for detecting the amount of light from the cold cathode type fluorescent lamp and lamp current control means for controlling the lamp current of the cold cathode type fluorescent lamp using an output corresponding to the detection output of the luminosity detection means as the input are linked with each other.

In a reproducing apparatus using a photoconductive photosensitive member, the objects of the present invention can be further accomplished by a method of controlling the luminous intensity of fluorescent lamp for the reproducing apparatus, which method is characterized in that a cold cathode type fluorescent lamp is used for eliminating the electrostatic charge on the surface of the photosensitive member, and a first stage of detecting the ambient temperature of the cold cathode type fluorescent lamp and a second stage of controlling the lamp current of the cold cathode type fluorescent lamp using an output corresponding to the detection output of the first stage as the input are linked with each other.

In a reproducing apparatus using a photoconductive photosensitive member, the objects of the present invention can still further be accomplished by a luminous intensity control apparatus for the fluorescent lamp of the reproducing apparatus, which luminous intensity control apparatus characterized in that a cold cathode type fluorescent lamp is used for eliminating the electrostatic charge on the photosensitive member, and temperature detection means for detecting the ambient temperature of the cold cathode type fluorescent lamp, and lamp current control means for controlling the lamp current of the cold cathode type fluorescent lamp using an output corresponding to the detection output of the temperature detection means are linked with each other.

In a preferred embodiment of the present invention, the luminous intensity control apparatus is constructed to be adjustable so that a predetermined level of luminous intensity corresponds to a lamp current generating that intensity, and the detection output of luminosity or temperature detection means when the luminous intensity of the lamp is at the predetermined level is used as a reference output and is applied as a reference input to the lamp current control means.

DESCRIPTION OF THE PREFERRED EMBODIMENTS

Figure 5:
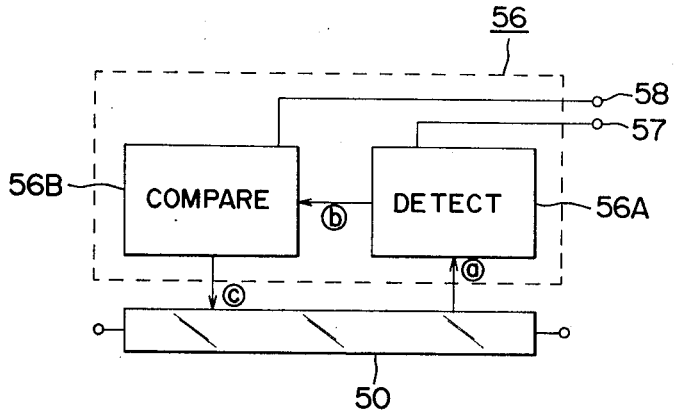
FIG. 5 is a block diagram useful for explaining the method and apparatus of the present invention.

The present invention is schematically illustrated in FIG. 5. In the drawing, reference numeral 50 represents the cold cathode lamp and reference numeral 56 represents a system for executing the luminous intensity controlling method of the present invention. Reference numeral 56A represents the first stage in which the luminosity or ambient temperature of the cold cathode lamp is detected (represented by arrow a ) and an output substantially proportional thereto is generated. Reference numeral 56B represents the second stage in which the output of the first stage (represented by arrow b ) is compared with predetermined luminous intensity (voltage corresponding to the luminous intensity, or the like) to control the lamp current of the cold cathode lamp 50 (represented by an arrow c ). Reference numerals 57 and 58 represent input terminals for adjusting the first and second stages 56A and 56B from outside, respectively.

First, a suitable luminosity of the cold cathode lamp 50, or the luminosity or ambient temperature of the cold cathode lamp 50 when the lamp provides a luminous intensity suitable for eliminating the electrostatic charge on the photosensitive member, is detected in the first stage and the detection output is applied to the second stage as a reference value. In the second stage, the lamp current is controlled so that the cold cathode lamp provides the optimal luminous intensity with respect to the input from the first stage. The optimal lamp current for the optimal luminous intensity may be adjusted in either stage or the second stage.

The luminous intensity of the cold cathode lamp changes with changes in the temperature of the cold cathode lamp or with changes in the power source. When the temperature inside the reproducing apparatus changes, the ambient temperature that affects the amount of light emitted of the cold cathode lamp also changes so that the input to the first stage changes. Accordingly, the input to the second stage from the first stage changes and in the second stage, this changing input is compared with the reference value corresponding to the abovementioned optimal luminous intensity and the change is fed back to the lamp current.

A luminous intensity control means having the temperature detection means of the present invention can also be explained with reference to the same block diagram as FIG. 5.

In FIG. 5, reference numeral 50 represents the cold cathode lamp and 56 represents the luminous intensity control means in accordance with the present invention. Reference numeral 56A represents the luminosity or temperature detection means and 56B represents lamp current control means. The cold cathode lamp 50 and the light intensity control means 56 are actuated by separate power sources from each other. The luminosity or temperature detection means 56A detect the quantity of light emitted or the ambient temperature of the cold cathode lamp 50 (corresponding to arrow a ), convert the result of the detection into an electric signal of an appropriate level and apply it to the lamp current control means 56B (corresponding to arrow b ). On the basis of the level of the input and the direction of control (promotion or restriction), the lamp current controlling means 56B controls the resistance and voltage of the cold cathode lamp 50 (corresponding to arrow c ) to decrease, maintain or increase the lamp current and thus control the luminous intensity of the light of the cold cathode lamp, which has a linear relation with the lamp current.

Figure 1:
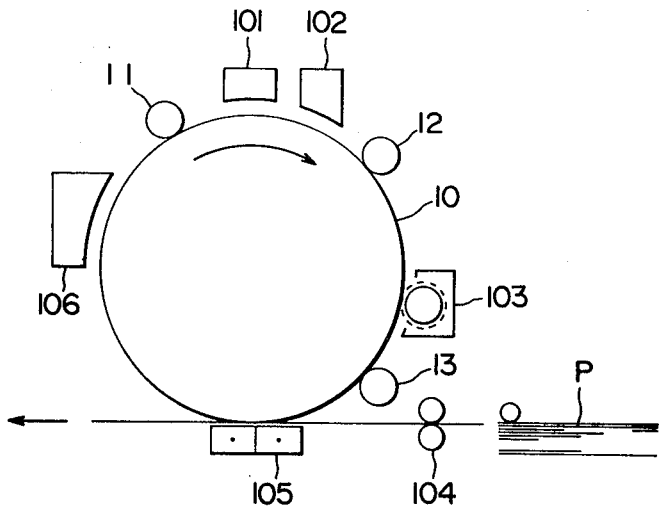
FIG. 1 is a partial schematic diagram useful for explaining the construction of an ordinary reproducing apparatus.
Figure 2:
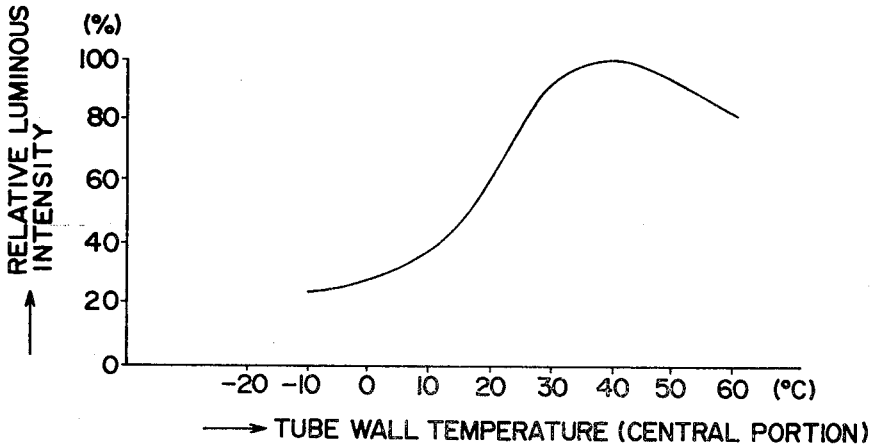
FIG. 2 is a graph showing the relation between the temperature and relative luminous intensity of a fluorescent lamp.
Figure 3:
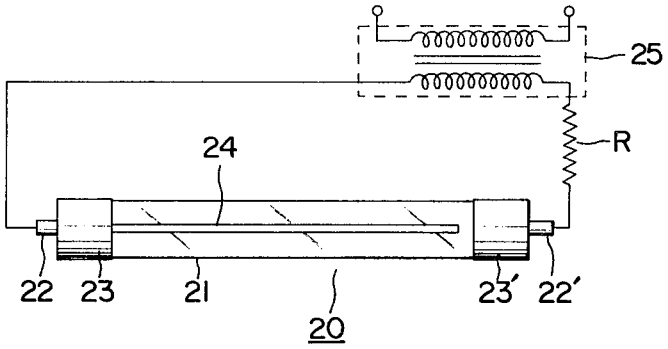
FIG. 3 is a schematic diagram useful for explaining a cold cathode lamp.
Figure 4:
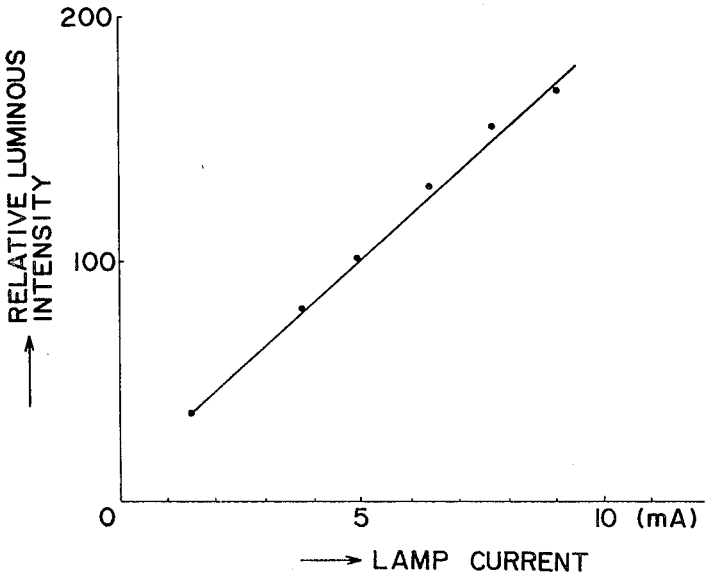
FIG. 4 is a graph showing the relation between the lamp current and the relative luminous intensity.

As described above with reference to FIG. 2, the luminous intensity of the cold cathode lamp 50 in the present invention depends significantly upon the inner temperature of the fluorescent lamp, and heat is hardly generated in the cold cathode lamp 50 itself by the discharge current so the inner temperature as well as the tube wall temperature of the fluorescent lamp are substantially equal to the ambient temperature. By using these properties, the present invention makes it possible to make the most of the ambient temperature as a parameter of the luminous intensity emitted by the cold cathode lamp.

The luminosity or temperature detection means 56A consist of a circuit for converting a change in voltage, current or resistance generated by a light receiving element which receives light emitted from the cold cathode lamp 50 into a suitable value or an electric output generated by a temperature detection element which detects the ambient temperature into a suitable value, and an auxiliary circuit. A cadmium sulfide cell, a photoconductive tube, a silicon photocell, a photodiode or a phototransistor may be used as the light receiving element. Though a thermistor is used as the temperature detection element in this embodiment, it is also possible to use a thermocouple, a ceramic temperature sensor, a diode temperature sensor, a transistor temperature sensor or the like.

Since the required function of the temperature detection element in the present invention is only to detect the ambient temperature as described above, it may be either a contact type or a non-contact type with respect to the object being detected. It is also possible to use in common the temperature sensor of other devices (such as a photosenstive member) as the temperature detection element of the present invention.

Figure 6:
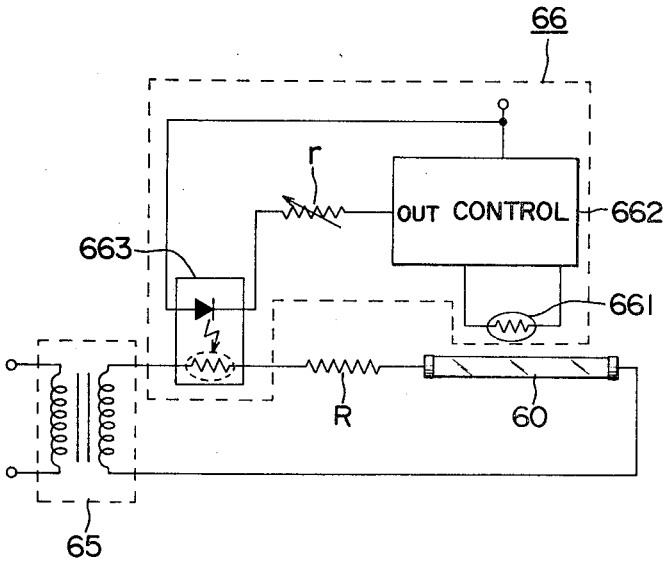
FIG. 6 is a circuit diagram useful for explaining the function of an embodiment of the present invention.

Various circuits may be used for the luminosity or temperature detection means 56A. FIG. 6 shows an example of such a circuit, in which changes in the ambient temperature of the cold cathode lamp are detected by a thermistor as changes in the resistance to generate the voltage change in accordance with the resistance change and to adjust the value by means of an OP amplifier (shown in FIG. 7).

The lamp current control means 56B adjusts the resistance or voltage of the operating power source circuit of the cold cathode lamp by means of the output from the abovementioned means and increases or decreases the lamp current so as to control the luminous intensity. It is possible, for example, to incorporate a photo-coupler or a transformer current control circuit in the lamp current control means so that the lamp current of the cold cathode lamp can be controlled to adjust the luminous intensity.

The electric signal generated by the light receiving element of the luminosity or temperature detection means 56A upon receiving the emitted light input from the cold cathode lamp or the electric signal generated by the temperature detection element upon detecting the temperature around the cold cathode lamp is adjusted to a suitable level, taken out as the detection output and then applied to the lamp current control means 56B to generate the output for controlling the lamp current of the cold cathode lamp 50. In this case, the light receiving element or temperature detection element incorporated in the two abovementioned means, the control element and the circuit are combined so that the lamp current control means 56B operates in matches the object of control. In other words, a change-over circuit is incorporated in the luminous intensity controlling means so that the lamp current increases when the luminous intensity decreases and the lamp current decreases when the luminous intensity increases. This arrangement is convenient when factors affecting the monotonous effective luminous intensity, such as contamination of the surface of the cold cathode lamp or that of the photosensitive member increase or decrease.

In practising the luminous intensity controlling method of the present invention or in putting the luminous intensity controlling apparatus of the invention into practical use, it is necessary to adjust the light sources of the charge eliminating means, partial exposing means and exposing means before transfer to the most preferred levels, that is, to the predetermined luminous intensity at which the charge can be eliminated in the predetermined manner. There is unavoidable variance in the performance from product to product for cold cathode lamps, the photosensitive member and luminous intensity control apparatus of the present invention, and this variance changes with the number of times it has been used and the time it has been in use.

In the present invention, in order to exclusively eliminate the abovementioned variances of various performance and to set the predetermined luminous intensity, the lamp current control means 56B are operated by adjusting the luminosity or temperature detection means 56A, increasing or decreasing the resistor (not shown) between the luminosity or temperature detection means 56A and the lamp current control means 56B or adjusting the comparison controlling circuit inside the means 56B, thus making it possible to make a lamp current, which generates the predetermined luminous intensity, to flow through the cold cathode lamp. (This current will hereinafter be referred to as the "prescribed current").

In the present invention, the lamp current control means can be constructed in such a fashion that the detection output from the luminosity or temperature detection means 56A when the means detects the luminosity or ambient temperature corresponding to the abovementioned predetermined luminous intensity is set as the reference output, and the lamp current is increased or decreased in response to the change in the output of the luminosity or temperature detection means with respect to the reference output so as to maintain the predetermined luminous intensity.

An embodiment of the present invention will now be described. FIG. 6 shows an embodiment in which a thermistor is used as the ambient temperature detection element and a photocoupler consisting of a combination of an LED and a CdS cell is used for a part of the lamp current control means.

In FIG. 6, reference numeral 60 represents the cold cathode lamp; 65 is a transformer; and R is a protective resistor interposed in the circuit between the cold cathode lamp 60 and the transformer 65. Reference numeral 66 represents the luminous intensity control means in accordance with the present invention; 661 is the thermistor; and 662 is a circuit which increases or decreases the magnitude of the electric input signal and also performs the comparison and adjustment. Reference numeral 663 represents the photocoupler consisting of the LED and CdS cell, wherein the CdS cell serves as the circuit resistor for the cold cathode lamp 60, receives light from the LED and changes its resistance, thereby changing the lamp current. Symbol r represents a variable resistor which sets the system of the luminous intensity control means so that when the output OUT of circuit 662 is constant, it adjusts the current to the LED of the photocoupler 663 so it generates the prescribed current providing the desired luminous intensity.

By replacing the thermistor with a cadmium sulfide light receiving element (hereinafter referred to as the "CdS cell"), the embodiment shown in FIG. 6 can be used as an embodiment in which luminosity detection means is employed instead of temperature detection means.

The luminous intensity controlling means 66 as well as the CdS cell or the thermistor 661 is disposed at positions where they do not interfere with the projection of light from the cold cathode lamp to the surface of the photosensitive member. Especially when the CdS cell is employed, it is preferred that the cell be disposed at or close to the center with respect to the axial direction of the tube of the cold cathode lamp. When the thermistor is employed, it is preferably disposed in the proximity of the tube wall close to the center of the cold cathode lamp 60. If the lamp current drops from the rated current due to a change in the power source or the luminous intensity drops from the predetermined luminous intensity due to degradation of the cold cathode lamp 60, for example, the tube wall temperature drops and the resistance of the thermistor 661 becomes greater. This change in turn drops its output OUT via the circuit portion 662, the result being an increase in the lighting current of the LED of the photo-coupler 663, an increase in its light emission luminous intensity, the decrease in the resistance of the CdS cell of the photo-coupler 663 serving as the circuit resistance of the cold cathode lamp and an increase in the lamp current. Accordingly, the cold cathode lamp is controlled so that the predetermined optimal luminous intensity is attained.

The abovementioned procedures are reversed when the lamp current of the cold cathode lamp increases beyond the prescribed current or the emission luminosity increases due to a change in the ambient temperature.

Figure 7:
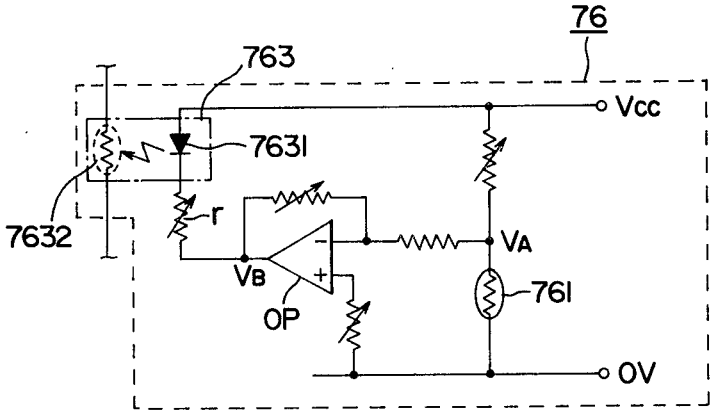
FIG. 7 is a circuit diagram showing an example of the portion of luminous intensity controlling means in the apparatus shown in FIG. 6.

An embodiment of the luminous intensity controlling means 66 encompassed by the dash line in FIG. 6 is illustrated in FIG. 7. Reference numeral 76 represent the luminous intensity control means; 761 is the thermistor; and 763 is the photo-coupler.

If the luminous intensity of the cold cathode lamp drops for some reason causing the illumination intensity to drop, the resistance of the thermistor increases in response to the drop. Accordingly, the voltage at VA rises and the input voltage to an inverting amplification circuit using an operational amplifier OP or the like rises. As a result, the voltage at VB drops and the current to the LED 7631 of the photo-coupler 763 is increased, whereby the resistance of the CdS cell 7632 interposed in the power feed circuit of the cold cathode lamp is decreased to increase the lamp current and the luminous intensity of the cold cathode lamp and to maintain a predetermined amount of light. This control system is adjusted by the variable resistor so as not to oscilate.

Though the operation of the present invention has been described with reference to an embodiment thereof, the present invention is not limited to it, in particular, and various other light receiving elements or temperature detection elements, circuit constructions, adjusting systems and lamp current control means may be employed.

In accordance with the present invention, when the electrostatic charge on the photosensitive member is eliminated by means of light, a cold cathode lamp which allows luminous intensity to be controlled easily is used so that the optimal amount of illumination is applied to the surface of the photosensitive member, and the changes in light are correctly fed back to the lamp current of the cold cathode lamp. Needless to say, the present invention can also be applied to luminous intensity control of the light source for making exposures when the cold cathode lamp is used to expose the original.

What is claimed is:

1. In a reproducing apparatus, in combination: a photoconductive photosensitive member; a cold cathode type fluorescent lamp for illuminating said member to produce an effect thereon; and a luminous intensity controlling apparatus for maintaining the luminous intensity of said lamp at some predetermined level comprising: detecting means for detecting the luminous intensity of said lamp and for providing an electric output signal related thereto; reference means for receiving said output signal and for comparing it to a reference signal representative of some predetermined luminous intensity and for providing a reference output signal based on the comparison; and lamp current control means for receiving said reference output signal and for controlling the lamp current of said lamp in accordance therewith to maintain the luminous intensity of said lamp at said predetermined level.

2. Reproducing apparatus according to claim 1 wherein said detecting means comprises light receiving means for detecting the luminous intensity of said lamp.

3. Reproducing apparatus according to claim 1 wherein said detecting means comprises temperature responsive means for detecting the ambient temperature to which said lamp is exposed to ascertain the luminous intensity of said lamp.

4. Reproducing apparatus according to claim 1 or 2 or 3 wherein reference means is adjustable so as to vary said reference signal and thereby change the level of said predetermined luminous intensity.

5. Reproducing apparatus according to claim 1 or 2 or 3 wherein said effect produced by said lamp is to expose an original being processed in said reproducing apparatus.

6. Reproducing apparatus according to claim 4 wherein said effect produced by said lamp is to expose an original being processed in said reproducing apparatus.

7. Reproducing apparatus according to claim 1 or 2 or 3 wherein said effect produced by said lamp is to eliminate an electrostatic charge on the surface of said photoconductive photosensitive member.

8. Reproducing apparatus according to claim 4 wherein said effect produced by said lamp is to eliminate an electrostatic charge on the surface of said photoconductive photosensitive member.

9. A method of operating a reproducing apparatus comprising a photoconductive photosensitive member; a cold cathode type fluorescent lamp for illuminating said member to produce an effect thereon; and a luminous intensity controlling apparatus to maintain the luminous intensity of said lamp at some predetermined level, said method comprising the steps of: detecting the luminous intensity of said lamp and providing an electric output signal related thereto; comparing said output signal to a reference signal representative of some predetermined luminous intensity to obtain a reference output signal based on the comparison; and controlling the lamp current of said lamp in accordance with said reference output signal to maintain the luminous intensity of said lamp at said predetermined level.

10. A method of operating reproducing apparatus according to claim 9 wherein the step of detecting the luminous intensity of said lamp comprises the step of detecting light.

11. A method of operating reproducing apparatus according to claim 9 wherein the step of detecting comprises the step of detecting the ambient temperature to which said lamp is exposed to ascertain the luminous intensity of said lamp.

12. A method of operating reproducing apparatus according to claim 9 or 10 or 11 including the step of adjusting said reference signal to thereby change the level of said predetermined luminous intensity.

13. A method of operating reproducing apparatus according to claim 9 or 10 or 11 wherein said effect produced by said lamp is to expose an original being processed in said reproducing apparatus.

14. A method of operating reproducing apparatus according to claim 12 wherein said effect produced by said lamp is to expose an original being processed in said reproducing apparatus.

15. A method of operating reproducing apparatus according to claim 9 or 10 or 11 wherein said effect produced by said lamp is to eliminate an electrostatic charge on the surface of said photoconductive photosensitive member.

16. A method of operating reproducing apparatus according to claim 12 wherein said effect produced by said lamp is to eliminate an electrostatic charge on the surface of said photoconductive photosensitive member.

* * * * *